US005816893A

United States Patent [19]

Kangasniemi

[11] Patent Number: 5,816,893

[45] Date of Patent: Oct. 6, 1998

[54] METHOD AND DEVICE FOR SHARPENING TOOLS, PARTICULARLY DENTAL HAND INSTRUMENTS

[75] Inventor: Pekka Kangasniemi, Turku, Finland

[73] Assignee: Lääkintämuovi Oy, Turku, Finland

[21] Appl. No.: 714,051

[22] PCT Filed: Mar. 24, 1995

[86] PCT No.: PCT/FI95/00157

§ 371 Date: Sep. 9, 1996

§ 102(e) Date: Sep. 9, 1996

[87] PCT Pub. No.: WO95/28254

PCT Pub. Date: Oct. 26, 1995

[30] Foreign Application Priority Data

Apr. 18, 1994 [FI] Finland ..... 941782

[51] Int. Cl.[6] ..... B24B 1/00

[52] U.S. Cl. ..... 451/28; 451/158; 451/363; 451/340; 451/406

[58] Field of Search ..... 451/231, 234, 451/241, 246, 278, 282, 408, 406, 409, 158, 419, 420, 428, 411, 414, 363, 340, 28

[56] References Cited

U.S. PATENT DOCUMENTS

| | | | |
|---|---|---|---|
| 869,068 | 10/1907 | Deputy . | |
| 2,442,440 | 6/1948 | Brocker | 451/363 |
| 2,578,309 | 12/1951 | Kroczek | 51/125 |
| 3,353,305 | 11/1967 | Wolf et al. | 451/158 |
| 4,509,268 | 4/1985 | Marquam et al. | 33/201 |
| 4,562,670 | 1/1986 | Maier et al. | 451/340 |
| 4,574,530 | 3/1986 | Handler et al. | 451/340 |
| 4,607,459 | 8/1986 | Rees | 451/406 |
| 4,854,080 | 8/1989 | Römhild et al. | 51/55 |
| 4,996,797 | 3/1991 | Laughton | 451/406 |
| 5,295,328 | 3/1994 | Olbrich | 51/122 |

FOREIGN PATENT DOCUMENTS

| | | | |
|---|---|---|---|
| 0 306 267 | 3/1989 | European Pat. Off. . | |
| 0 307 740 | 3/1989 | European Pat. Off. . | |
| 39 34 365 C1 | 2/1991 | Germany . | |
| 406023657 | 2/1994 | Japan | 451/411 |

*Primary Examiner*—Robert A. Rose
*Assistant Examiner*—George Nguyen
*Attorney, Agent, or Firm*—Adduci, Mastriani & Schaumberg, L.L.P.

[57] ABSTRACT

A method and apparatus for sharpening tools, particularly hand instruments used in dental care. The apparatus includes a fixed base (19) and a rotary plate (14) fitted thereon, a grinding stone (10) pivoted on an axle (11), and a motor (20) for rotating the grinding stone. According to the invention, adjacent to the circumference (10') or the side surface (10") of the grinding stone is fitted a sharpening support (30) which is supported on the rotary plate (14) and on which the instrument to be sharpened rests during sharpening. The rotary plate (14) is arranged rotatively round an axis (41) between the instrument to be sharpened and the sharpening support (30) or through a point in proximity with the contact point.

12 Claims, 10 Drawing Sheets

METHOD AND DEVICE FOR SHARPENING TOOLS, PARTICULARLY DENTAL HAND INSTRUMENTS

BACKGROUND OF THE INVENTION

The invention relates to a method and apparatus for sharpening tools, particularly hand instruments for dental care.

About one half of the dental operations are performed with mechanical instruments, for example drills, the other half is performed with hand instruments. About one half of the hand instruments are so-called wearing instruments and the other half are so-called non-wearing instruments.

Instruments wear most when used for working hard dental enamel and dentin in the removal of damaged tissue for the filling. These instruments are called preparation instruments. They are typically chisels, flat chisels, chippers and gouges. They are very small in size, 0.5–2.0 mm wide. Their blade angle must be and must remain absolutely correct after each sharpening.

Instruments wear the second most when used for scaling hard coatings, tartar and cement from the teeth and when root surfaces are being levelled. These instruments used for the care of the supportive tissue are typically tartar scalers, general or finishing curets or tartar hook scalers. These are also small in size, the cross-sectional dimensions of the blades vary in the range 0.8–1.0 mm. Angles and dimensions must also remain unchanged as far as possible after sharpening.

Instruments wear the third most when used for finishing hardened tooth fillings and removing excess filling. The instruments of this group are typically knives and gouges. They are small and thin in shape.

Modern dental instruments are made of stainless steel. They have relatively poor wear resistance and the blades wear fairly quickly. Therefore, in principle, the wearing instruments should be resharpened almost each time after using.

It practice, the most common way of sharpening is grinding with a hand grinding stone. This is, however, a slow and exacting sharpening method and thus, in practice, it is carried out too seldom. This has the outcome that a dentist often works with blunt and inefficient tools or that he tries to omit the hand instrument step. It is obvious that the quality of the work will suffer from this.

To facilitate sharpening of instruments and to make sharpening more effective various types of sharpening apparatuses have been developed and manufactured. Following of the known sharpening apparatuses may be mentioned:

1) Periostar$^R$ (Mikrona Technologia AG)

The structure of the apparatus is described in the patent publication EP 307740. The instrument to be ground is fastened by a screw mechanism and a guide mechanism to a bow whereby the blade can be guided in a correct position against the side of the grinding stone. The tilt angle of the grinding stone is selected with a control knob and an automatic lever mechanism changes the tilt angle when the stone moves from one side of the blade to the other. The direction of rotation of the stone changes at the midpoint of the trajectory. A spring mechanism maintains a constant contact pressure between the blade and the stone during sharpening.

2) Honing Machine

This apparatus has a to-and-fro moving socket into which the grinding stones of varying shapes and coarseness can be attached according to the need. The apparatus uses two guide units to show the correct position of the blade.

3) LM sharpening device

The apparatus has a sharpening disc which rotates bidirectionally at two speeds and a self-controlling guide and an instruction card system to accomplish a correct sharpening position of the instrument.

4) Safident sharpening apparatus

The apparatus has a simple diamond or a ceramic wheel with a shaft linked directly either vertically or horizontally to the shaft of a motor. The apparatus has no control system whatsoever.

Most of the known apparatuses are not, however, easy to use and efficient at the same time. Operation of some of the apparatuses requires more expertise than manual sharpening and some apparatuses are technically so complicated that the operator cannot master the apparatus or operation is so tedious that the operation cannot be carried out in any realistic time. On the other hand, apparatuses which are too simple spoil small blades with incorrect grinding. When the faults are mended, the steel wears too much and the blade gets thinner and fragile.

SUMMARY OF THE INVENTION

The purpose of this invention is to eliminate the above problem and accomplish a new method and apparatus without the above drawbacks. The method according to the invention is easy and rapid to carry out and the apparatus used in the method has a simple structure and is reliable to use.

The invention relates to a method for sharpening tools, particularly hand instruments used for dental care, by means of a motor-rotated grinding stone. According to the invention the instrument is held in place in a correct position by supporting it with one hand on an adjustable sharpening support mounted on a rotary plate so that the blade of the instrument to be sharpened touches the circumference or the side surface of the rotating grinding stone. The grinding stone is rotated by moving it with the other hand round such an axis that goes through the contact point between the instrument to be sharpened and the sharpening support or a point in proximity with the contact point, the circumference respectively the side of the grinding stone thereby moving along the blade to be sharpened. The instrument is kept at such a position relative to the curved circumference of the grinding stone or the grinding stone is tilted relative to the plane of the surface of the sharpening support as to obtain exactly the desired tool angle during sharpening.

The invention also relates to an apparatus for sharpening tools, particularly hand instruments used for dental care, the apparatus comprising a fixed base and a rotary plate fitted thereon as well as a grinding stone pivoted on an axle. The apparatus further comprises a motor for rotating the grinding stone. The invention is characterized in that adjacent to the circumference or the side surface of the grinding stone is fitted a sharpening support, which is supported on the rotary plate and on which the instrument to be sharpened rests during sharpening. The invention is further characterized in that the rotary plate is arranged rotatable round an axis which goes through the contact point between the instrument to be sharpened and the sharpening support or through a point in proximity with the contact point.

In the ideal case, said axis goes through the contact point between the instrument to be sharpened and the sharpening support. However, it is to be noted that, when sharpening is performed against the circumference of the grinding stone pivoted on a horizontal axle, said contact point also moves in horizontal direction, when the sharpening support is raised or lowered, so that said axis will no more go through the said contact point. It could be possible to arrange the location of the axis to be movable in horizontal direction, for example so that the location of the axis in the fixed base is transferable or so that the location of the groove or hole corresponding to the axis in the rotary plate is selectable. In practice however, the apparatus works satisfactorily although said contact point slightly deviates from the location of the axis in the horizontal direction. Tests with a grinding stone with a diameter of 50 mm have shown that the horizontal deviation can be in the range 0–5 mm. The term "in the proximity of the contact point", which also appears in the claims, means that the perpendicular distance between the axis and the instrument/sharpening support contact point can be 0–5 mm.

According to a preferred embodiment the axis round which the rotary plate revolves stands in a vertical plane.

The axis round which the rotary plate revolves need not in practice denote a physical axle stub or extension of a physical axle stub but it may denote merely a theoretical axis.

According to another preferred embodiment the grinding stone is rigidly attached to the axle on which it rotates and the ends of the axle are mounted on bearings on axle supports attached to the rotary plane.

According to yet another preferred embodiment the driving unit of the grinding stone is a motor-rotated, spring-loaded drive wheel extending from the motor to the side or circumference of the grinding stone and pressing against the side or circumference of the grinding stone.

According to yet another preferred embodiment the axle of the grinding stone is located on the axle of the motor and that the motor is supported on a bow with its both ends rotatably mounted on bearings on both sides of the grinding stone on axle which goes through the diameter of the grinding stone. Consequently, since sharpening of an instrument is performed against the side surface of the grinding stone, this solution enables one to arrange adjustable tilting of the grinding stone relative to the plane of the surface of the sharpening support. A desired tool angle is obtained by selecting a suitable tilt.

According to yet another preferred embodiment the sharpening support is adjustable into at least two predetermined constant positions, for example so that a measure $L_1$ of the sharpening support corresponds to one constant height and its measure $L_2$ corresponds to another desired constant height and the bottom of the sharpening support has recesses in the bottom and in the side which correspond to pins in the rotary plate. Thus height adjustment is performed by simply turning the sharpening support. According to another alternative, a separate piece is used as the sharpening support which corresponds to one of the two desired constant heights. This kind of separate piece is preferably hinged to the actual sharpening support.

According to a preferred embodiment the rotary plate does not form a base, on which the components like the grinding stone, sharpening support etc. are supported, but the rotary plate forms a protecting dome at least partly covering the components. In this case the grinding stone and the other components are suspended from the rotary plate. This kind of dome-like rotary plate can be linked to an axle stub on a fixed base by means of a diametral bar fitted below the rotary plate, for instance. More preferably, the rotary plate is mounted on bearings on the fixed base by means of a ball ring in the periphery of the rotary plate.

BRIEF DESCRIPTION OF THE DRAWINGS

The invention will be described in the following with reference to the enclosed drawings in which.

DETAILED DESCRIPTION OF THE PREFERRED EMBODIMENTS

Figure 1:
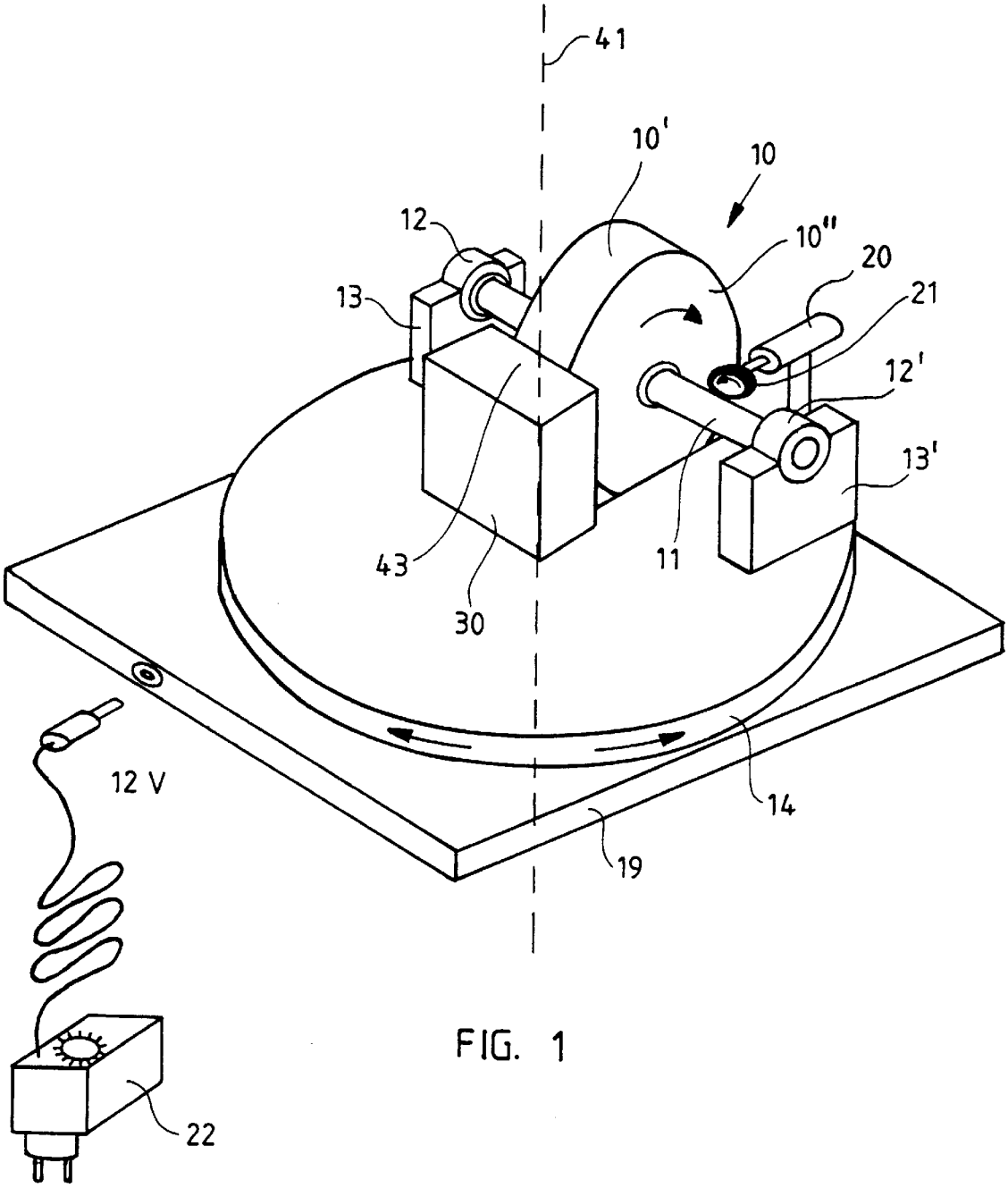
FIG. 1 shows one embodiment of the apparatus of the invention as a perspective view.

FIG. 1 shows one embodiment of the apparatus of the invention as a perspective view. On top of a fixed base 19 a rotary plate 14 is fitted, which is arranged freely rotatable to both directions even through 360 degrees so that the rotary plate 14 is mounted on bearings on a vertical axle stub 40 on the fixed base 19 (the axle stub is not shown in FIG. 1). The grinding stone 10 of the apparatus is pivoted on an axle 11. The grinding stone 10 is rigidly attached to the horizontal axle 11 with its ends mounted on bearings 12, 12' on axle supports 13, 13 attached to the rotary plate 14. The motor 20 is a DC motor with a stepless speed control so that the rotational speed of the grinding stone 10 can be varied in the range 500–1000 RPM. The reference numeral 22 denotes an adapter containing a transformer and a rectifier. The driving unit of the grinding stone is a motor-rotated, spring-loaded drive wheel 21 extending from the motor 20 to the side surface 10" of the grinding stone and pressing against the side surface 10". Adjacent to the circumference 10' of the grinding stone is fitted a sharpening support 30 supported on the rotary plate 14. Throughout the sharpening operation the instrument to be sharpened is held in place in a correct position by supporting it with one hand on the sharpening support 30 so that the blade of the instrument to be sharpened touches the circumference 10' of the rotating grinding stone. The rotary plate 14 is arranged rotatable round an axis 41 which goes through the contact point 43 between the instrument to be sharpened and the sharpening support 30 or through a point in proximity with the contact point 43. The contact point 43 can be seen more clearly in FIG. 8B. The apparatus can be protected with a protective dome not drawn in FIG. 1.

In this solution, the grinding stone is rigidly fixed to the axle with its ends mounted on bearings 12, 12' on axle supports 13, 13 attached to the rotary plane 14. The bearing housings of the axle supports 13, 13' have an open structure. This kind of open bearing structure together with the described solution for driving the grinding stone makes replacement of the grinding stone rapid and simple.

Figure 2:
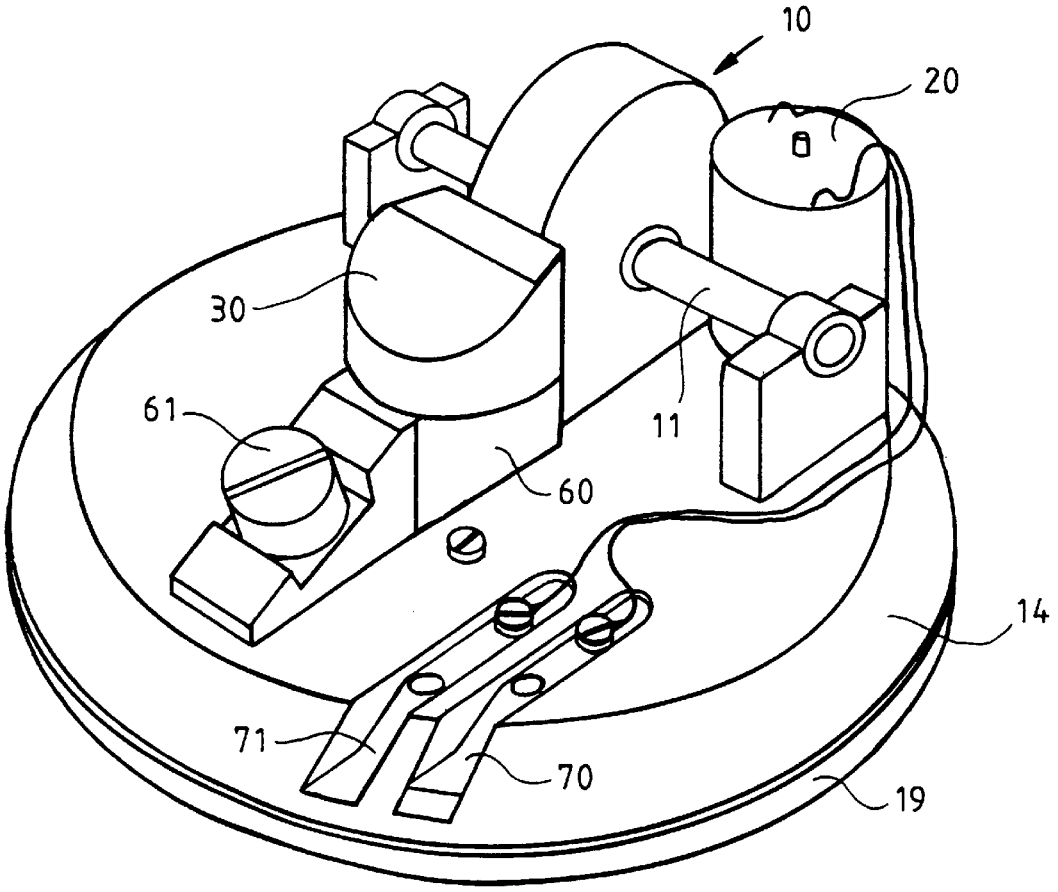
FIG. 2 shows a second embodiment of the apparatus of FIG. 1.
Figure 3:
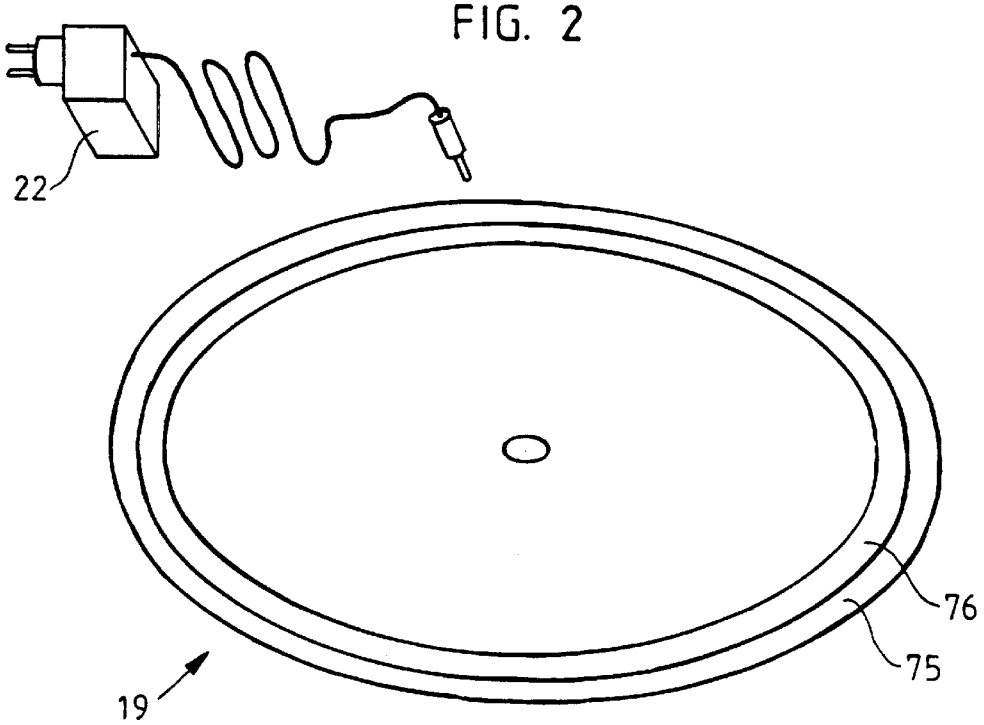
FIG. 3 shows the fixed base as a perspective view.

FIG. 2 shows a second embodiment of the apparatus of FIG. 1. The sharpening support 30 abuts on a raised part 60 on the rotary plate. The reference numeral 61 denotes an adjustment screw by which the sharpening support against the grinding stone 10 is adjusted. The reference numerals 70 and 71 denote brushes from which electric wires go to the motor 20. The lower surfaces of the brushes make contact with copper rings 75, 76 fitted on the upper side of the fixed base (FIG. 3), to which electricity is conducted from the mains via an adapter 22, one of them corresponding to the + terminal and the other the − terminal. The driving wheel, which is attached to the motor, has not been drawn in the figure.

Figure 4A:
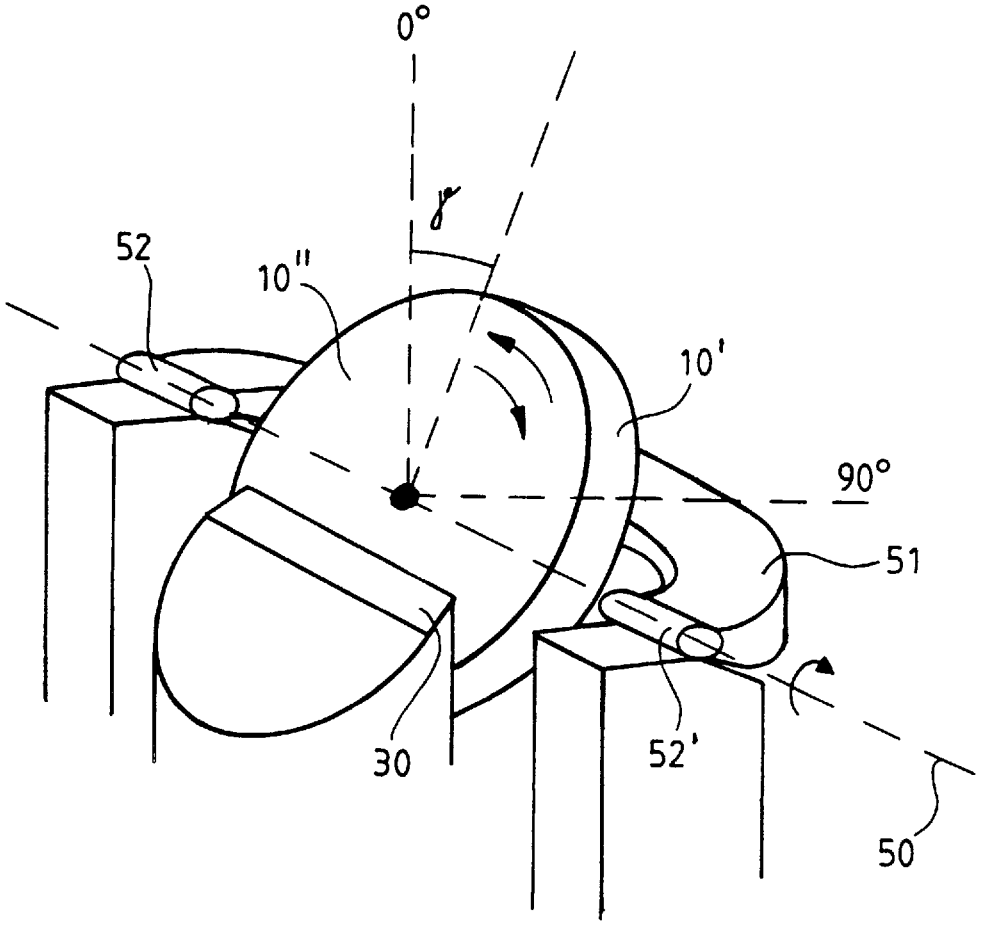
FIG. 4A and 4B show a third embodiment of the apparatus of the invention.
Figure 4B:
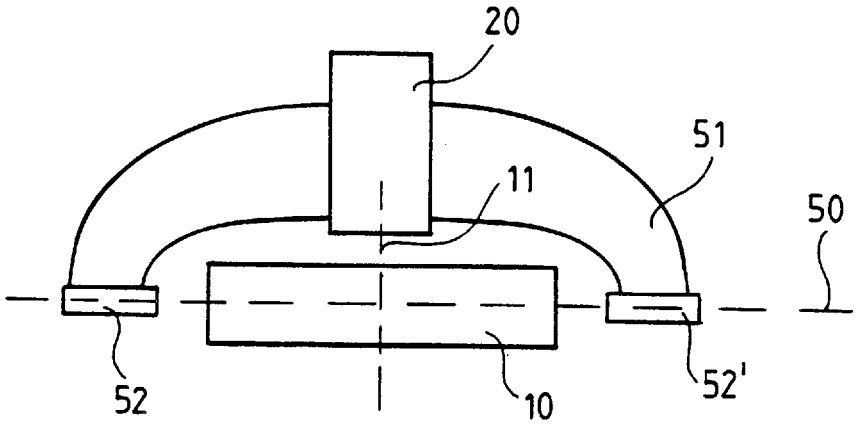

FIGS. 4A and 4B show a third embodiment of the apparatus of the invention. FIG. 4A shows the apparatus as a perspective view and FIG. 4B shows the apparatus seen from above. The axle 11 of the grinding stone 10 is located on the axle of the motor 20 and the motor 20 is supported on a bow 51 with its both ends 52, 52' rotatably mounted on bearings on both sides of the grinding stone on an axis 50 which goes diametrically through the grinding stone. In this solution, sharpening is performed against the side surface 10" of the grinding stone. The tilt angle Γ of the grinding stone relative to the surface of the sharpening support 30 is adjustable in this solution. By choosing a correct tilt angle Γ, when sharpening is performed against the side surface 10" of the grinding stone, one obtains a desired tool angle α.

Figure 5:
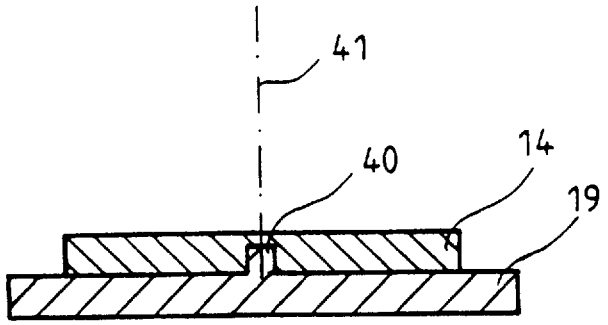
FIG. 5 shows fitting of the rotary plate of the apparatus to a rigid base as a cross-section according to one embodiment.

The cross-section of FIG. 5 shows that the rotary plate 14 is mounted on bearings on a vertical axle stub 40 on the fixed base 19. In this solution the axle stub 40 extends only to a certain distance into the rotary plate 14 but it could alternatively extend through the rotary plate 14. The rotary plate is freely rotatable in both directions. According to one embodiment the electric current required by the motor can be conducted through wires resting on the fixed base 19 and the rotary plate 14 via the axle stub 40 into the motor. In this case the axle stub 40 has two terminals and is provided with brushes.

Figure 6:
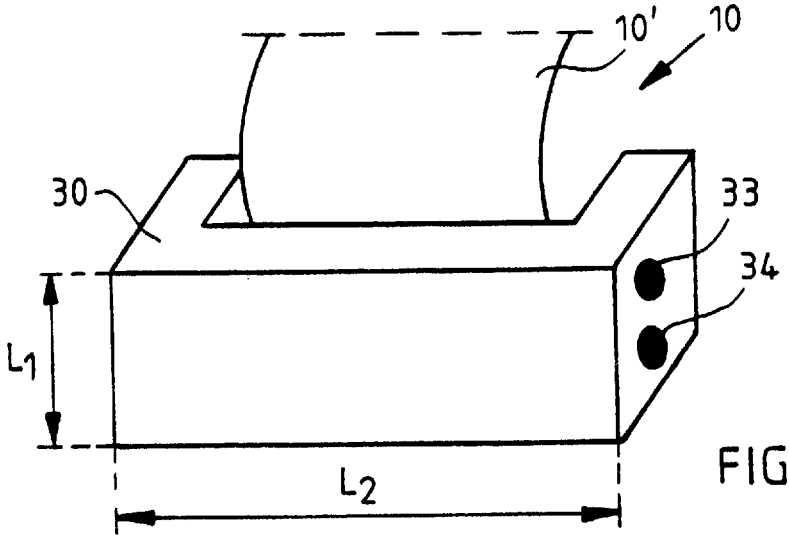
FIG. 6 shows the sharpening support of the apparatus as a perspective view according to one embodiment.
Figure 7:
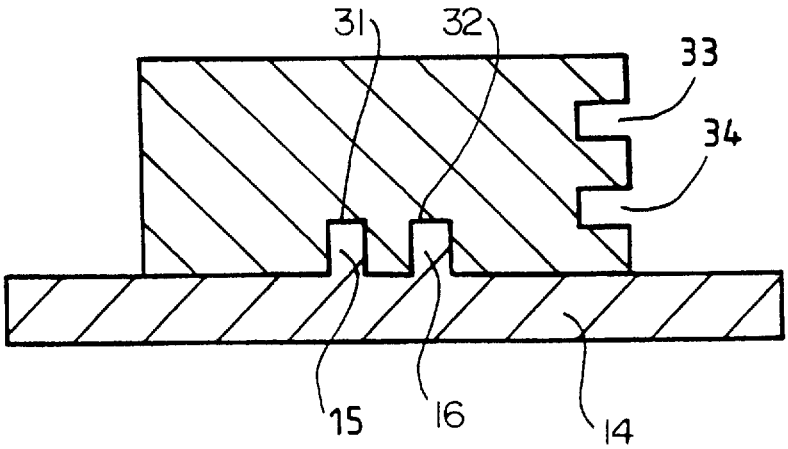
FIG. 7 shows joining of the sharpening support of FIG. 6 to the rotary plate as a cross-section.

FIG. 6 shows the sharpening support 30 located adjacent to the circumference 10' of the grinding stone which can be adjusted quite simply into two predetermined constant heights from the plane of the rotary plate 14. The measure $L_1$ of the sharpening support corresponds to one constant height and its measure $L_2$ corresponds to another constant height. FIG. 7, shows the recesses 31, 32 and 33, 34 respectively in the bottom and in the side of the sharpening support corresponding to the pins 15 and 16 in the rotary plate 14. Height adjustment is performed simply by turning the sharpening supports. The measures $L_1$ and $L_2$ are chosen suitably to correspond to tool angles (75 and 60 degrees) occurring in most instruments.

Operation of the apparatus becomes apparent in FIGS. 8–11.

Figure 8A:
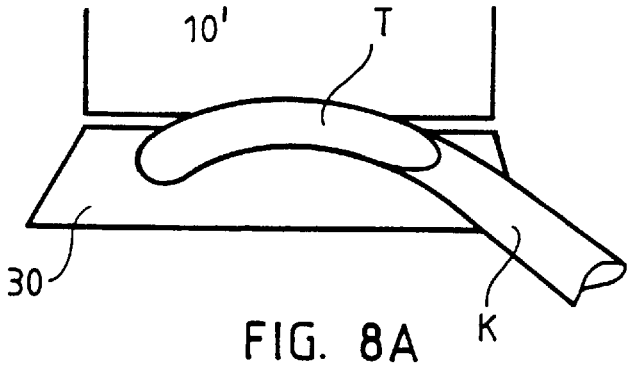
FIG. 8A and 8B show the position of one type of instrument in sharpening.
Figure 8B:
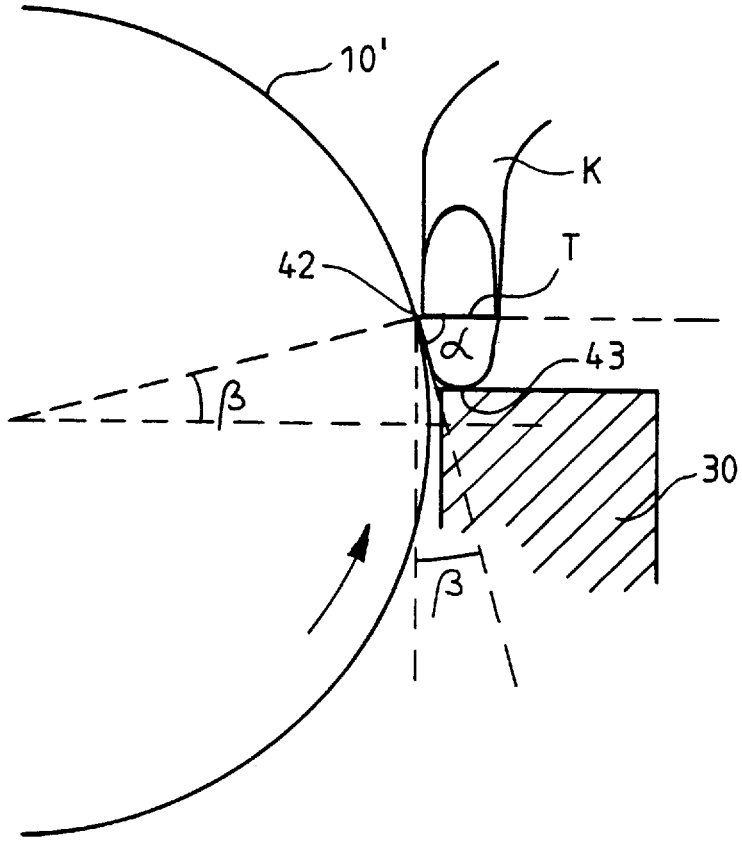

FIGS. 8A and 8B present the sharpening of a curet. FIG. 8A shows from above the curet K resting on the upper surface of the sharpening support 30 so that the blade being sharpened touches the circumference 10' of the grinding stone. The working face T is kept horizontal. It is seen in FIG. 8B that the blade being sharpened is raised from the plane of the horizontal diameter of the grinding stone so that the radius of the grinding stone drawn from the contact point 42 makes an angle which corresponds to the taper angle β of the blade with the horizontal radius. In this way choosing a correct contact point a desired tool angle α (α=90°−β) of the curet is obtained. Since a suitable tool angle a for a curet is 75° one must choose β=15°.

During the sharpening the operator holds the instrument K in place in a correct position with one hand. Using his other hand he rotates the rotary plate together with all the equipment supported thereon round its axis 41 to-and-fro along the blade being sharpened. Depending on the shape of the blade he is able to sharpen the edge at three sides without lifting the instrument from the sharpening support. If straight blades (chisels etc.) are sharpened, the rotary plate can be held immobile as well. Sharpening is possible both on the front and back side of the grinding stone. Both left- and right-handed operation is possible. Although the grinding stone can rotate in both directions on its axle, it is a safer practice to perform the sharpening so that the grinding stone rotates away from the blade in the direction of the arrow in FIG. 8B.

Figure 9A:
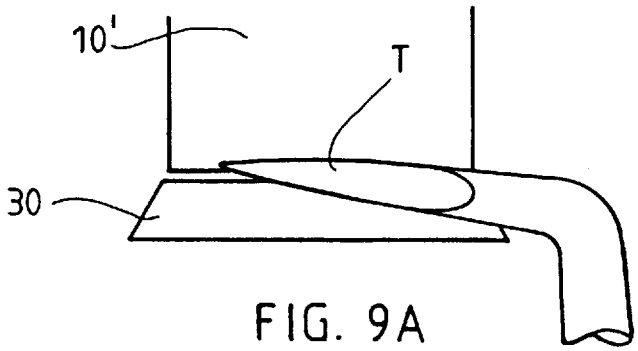
FIG. 9A and 9B show the position of a second type of instrument in sharpening.
Figure 9B:
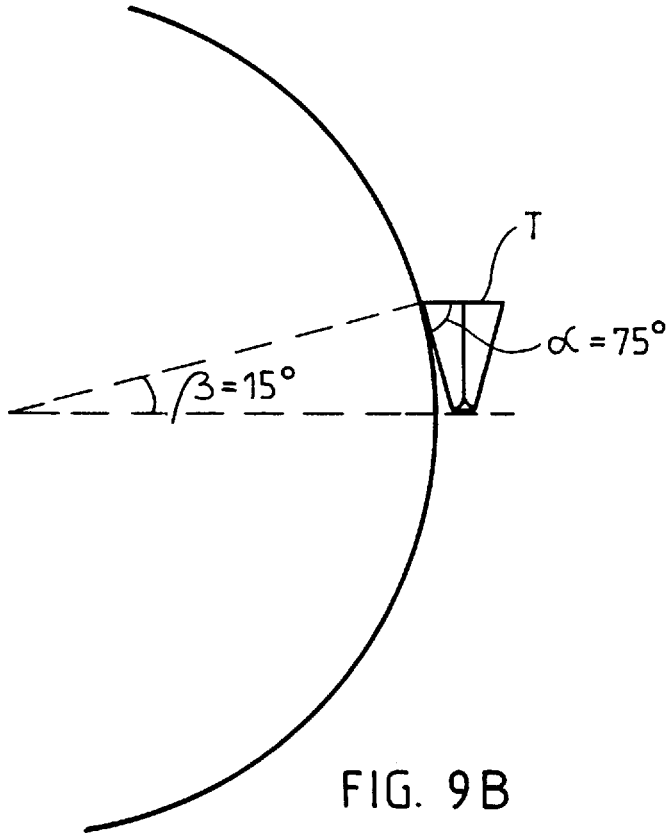

FIGS. 9A and 9B show sharpening of a sickle. Also in this case the working face of the instrument is kept horizontal and β is chosen =15°. Because the front edge of this instrument is very sharp, sharpening is first performed on one side of the blade from bottom to edge. Next the rotary plate/stone is turned and the other side is sharpened respectively.

Figure 10A:
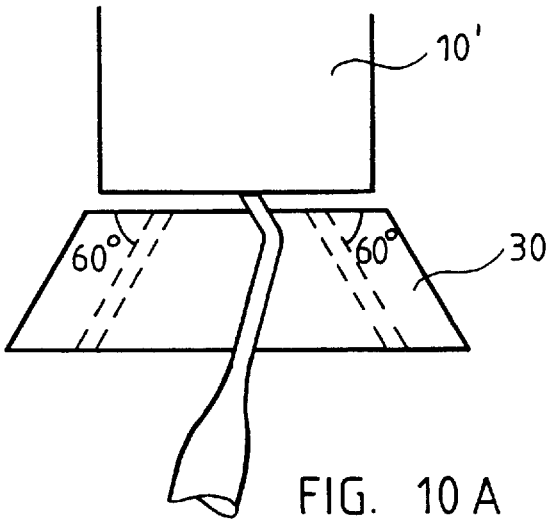
FIG. 10A and 10B show the position of a third type of instrument in sharpening.
Figure 10B:
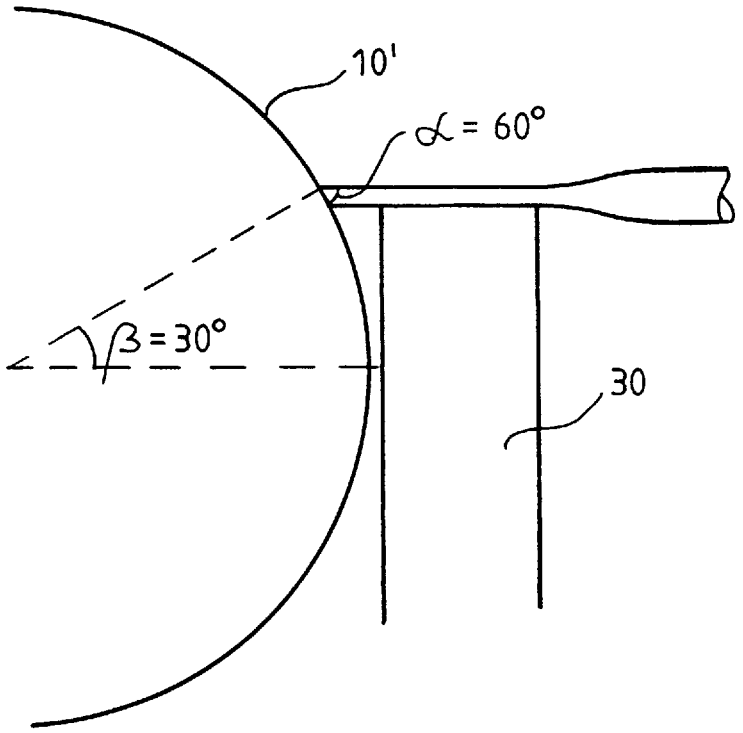

FIGS. 10A and 10B show sharpening of a levelling instrument. The tool angle α of this type of instrument is suitably 60° so that one must choose the height of the sharpening support such that β equals to 30°. To facilitate correct positioning of the instrument the upper surface of the sharpening support is provided with pre-drawn lines.

Figure 11:
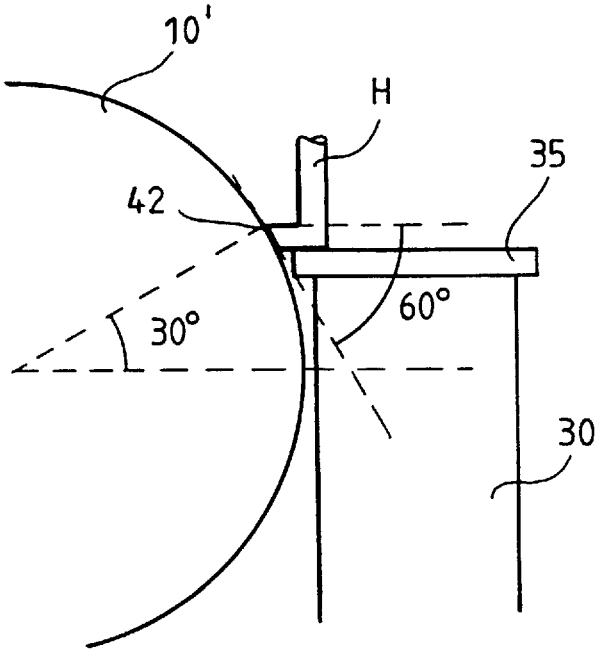
FIG. 11 shows the position of a fourth type of instrument in sharpening.

FIG. 11 shows the sharpening of a hook. The tool angle a of this type of instrument is also suitably 60°. In order to have a proper support for this small sized hook H near the grinding stone, an additional part 35 which extends nearer to the contact point 42 is fitted on top of the sharpening support 30.

Figure 12:
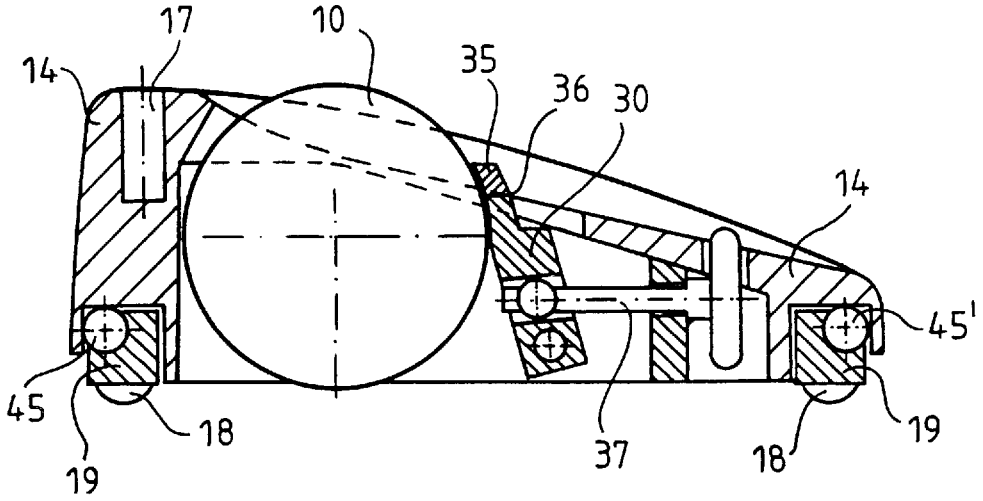
FIG. 12 shows a fourth embodiment of the apparatus of the invention as a cross-section.
Figure 13:
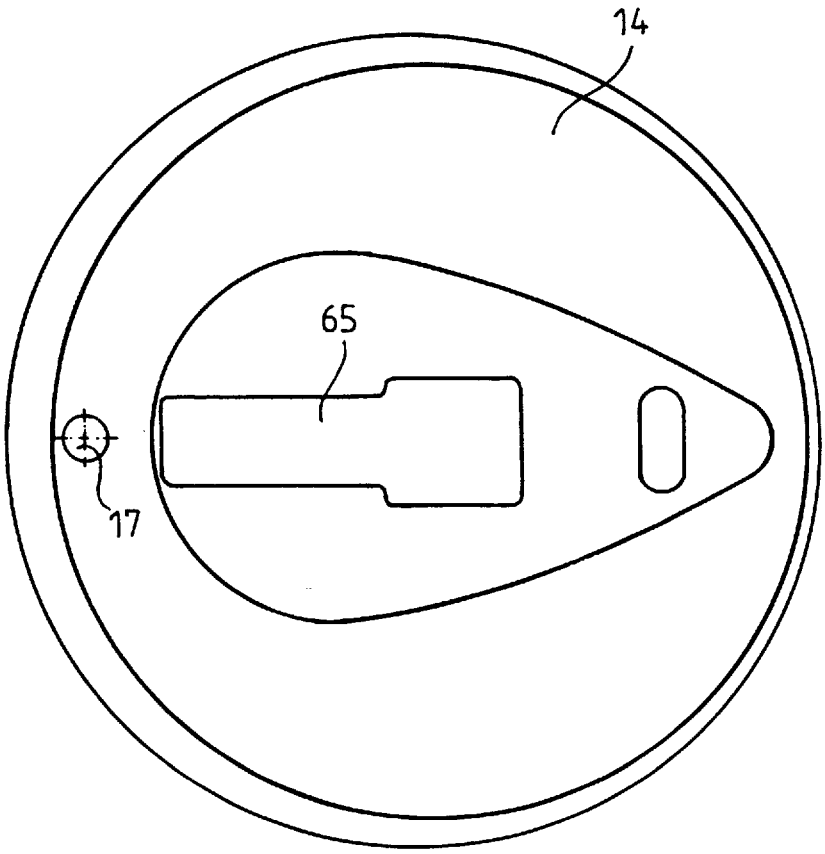
FIG. 13 shows the apparatus of FIG. 12 seen from above.

FIG. 12 shows a solution of the apparatus according to the invention as a cross-section in which the rotary plate 14 does not form a base, on which the components (the grinding stone 10, sharpening support 30, etc.) are supported, but the rotary plate 14 forms a protective dome partly covering said components. In this solution the grinding stone 10 and the other components are suspended from the rotary plate 14. It is naturally important for the use of the apparatus that the dome-like rotary plate 14 does not entirely cover the grinding stone 10 nor the sharpening support 30. The dome-like rotary plate 14 is shaped so that the part of the grinding stone and sharpening support that are essential to sharpening remain above the surface of the rotary plate. As shown in FIG. 13 the rotary plate 14 is provided with an lead-through opening 65 for these components. A recess 17 is formed in the rotary plate into which a turning handle of the plate can be embedded. The sharpening support 30 supported on the rotary plate is adjustable in horizontal direction by means of an adjusting device 37. Height adjustment of the sharpening support is performed by means of an additional part 35 hinged to the edge 36 of the sharpening support 30 which can be readily turned on top of the sharpening support and off therefrom. The rotary plate 14 is mounted on bearings on the fixed base 19 by means of a ball ring 45, 45', 45". . . in the periphery of the fixed base. FIG. 12 shows only two balls 45 and 45' but in practice the number of balls is higher. The fixed base 19 forms in this solution an annular piece provided with anti-skid stops 18, 18'.

Figure 14:
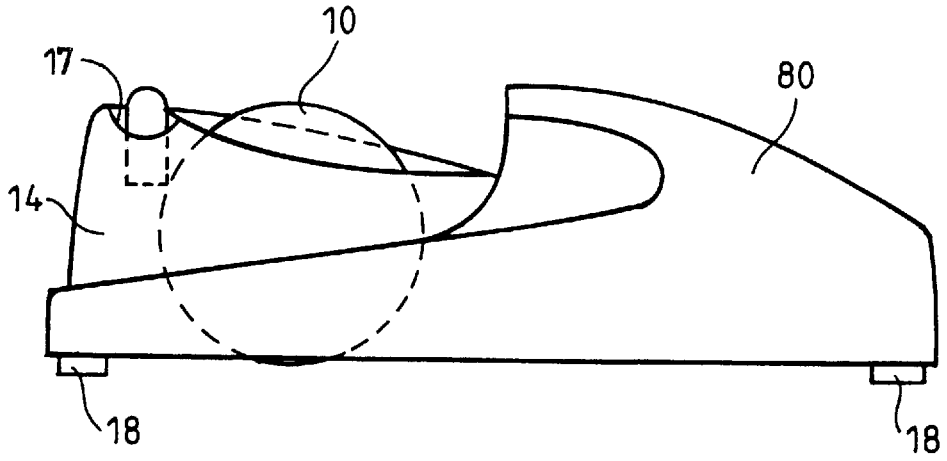
FIG. 14 shows the apparatus of FIG. 12 provided with a hand support seen from the side
Figure 15:
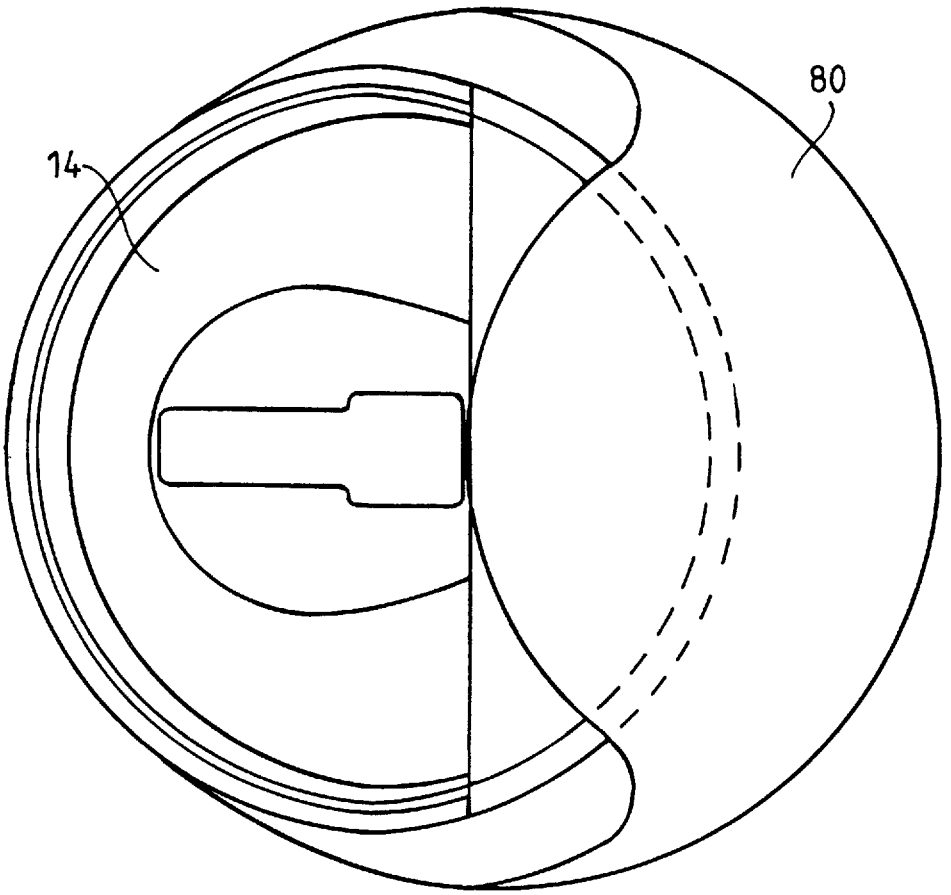
FIG. 15 shows the apparatus of FIG. 14 seen from above.

FIGS. 14 and 15 show the apparatus of FIG. 12 provided with a cover 80 which partly covers the apparatus and serves as the hand support during sharpening. The cover 80 is attached to the fixed base 19.

The greatest benefits of the invention are that the apparatus is so simple that risk for inaccurate sharpening is minimized. The facts that the blade to be sharpened needs no mechanical mounting, that manual supporting and changing is quick and that the accuracy due to the sharpening support is sufficient, make sharpening time per blade realistically fast, only a few seconds per blade. The contact force against the grinding stone can be adjusted manually which makes adjustment of sharpening rate simple for blades of various hardness and degree of wear. Sharpening can be readily stopped during sharpening to prevent excess heating of the blade.

The above figures present such a solution in which the axle, round which the rotary plate turns, is in a vertical plane. This is in practice the most preferrable embodiment but the invention is not limited to this. It is also possible that the axle round which the rotary plate turns is in a horizontal plane.

Although the above description deals with the use of the apparatus for sharpening tools used for dental care, it will be understood that the apparatus also suits to sharpening of other tools. In particular, it is suitable for such tools used in precision mechanics which have blades to be sharpened on more than one side or in which the blades are curved or tilted.

It is obvious to a specialist in the field that the various embodiments of the invention can vary within the limits of the enclosed claims.

I claim:

1. An apparatus for sharpening objects, comprising i) a fixed base;

ii) a plate rotatively mounted on said base and having an axis of rotation through a center of said plate;

iii) a grinding stone rotatively mounted on said plate, said grinding stone having a shape of a disc with two sides, a circumference, and a central axis of rotation normal to said sides;

iv) a motor operatively connected to said grinding stone for imparting rotation about said central axis of rotation of said grinding stone; and v) a support for an object to be sharpened, said support mounted on said plate adjacent either said circumference or one of said sides of said grinding stone such that a contact point is defined between the object to be sharpened and either said circumference or said side;

with the proviso that said axis of rotation of said plate extends through said contact point or through a point in proximity with said contact point.

2. The apparatus of claim 1, wherein said axis of rotation of said plate is vertical.

3. The apparatus of claim 1, wherein said grinding stone is rigidly attached to an axle rotatively supported on bearings operatively mounted on said plate.

4. The apparatus of claim 1, wherein said motor is connected to said grinding stone by a driving wheel which extends from said motor and which is urged against said side or circumference of said grinding stone by a spring.

5. The apparatus of claim 1, wherein said grinding stone is rigidly attached to an axle of said motor, and wherein said motor is supported on a bow whose ends are rotatively mounted on bearings on both sides of said grinding stone on an axis which goes diametrically through said grinding stone.

6. The apparatus of claim 1, wherein said support for an object to be sharpened has at least two predetermined fixed positions.

7. The apparatus of claim 6, further comprising an additional height adjustment member which is pivotably mounted on said support for an object to be sharpened such that said member can move onto or from the top of said support.

8. The apparatus of claim 1, wherein said plate is rotatively mounted by a plurality of ball bearings on said fixed base in a ball ring on a periphery of said plate.

9. The apparatus of claim 1, wherein said motor is a DC motor with a stepless speed control.

10. A method for sharpening objects, comprising the steps of:

providing the apparatus of claim 1, maintaining an object to be sharpened in position on said support for an object to be sharpened such that a point of contact is created between a surface of said object and the circumference or side surface of said grinding stone while said stone is rotating;

rotating said plate and thereby said grinding stone about said axis of rotation of said plate, thereby moving said point of contact along a surface of the object to be sharpened, wherein said object is maintained in such a position relative to the curved circumference of said grinding stone, or the grinding stone is tilted relative to a plane of said support for an object to be sharpened such that the desired angle of sharpening of said object is achieved.

11. The method of claim 10, wherein the force applied to urge the object against the grinding stone and the time of contact of the object and said stone are manually controlled.

12. An apparatus for sharpening objects, comprising i) a fixed base;

ii) a dome rotatively mounted on said base and having an axis of rotation through a center of said dome;

iii) a grinding stone rotatively suspended from said dome, said grinding stone having a shape of a disc with two sides, a circumference, and a central axis of rotation normal to said sides;

iv) a motor operatively connected to said grinding stone for imparting rotation about said central axis of rotation of said grinding stone; and v) a support for an object to be sharpened, said support suspended from said dome adjacent either said circumference or one of said sides of said grinding stone such that a contact point is defined between the object to be sharpened and either said circumference or said side;

with the proviso that said axis of rotation of said dome extends through said contact point or through a point in proximity with said contact point, and with the further proviso that said dome does not entirely cover said grinding stone or said support for an object to be sharpened.

* * * * *